US008127867B1

(12) United States Patent
Droke

(10) Patent No.: US 8,127,867 B1
(45) Date of Patent: Mar. 6, 2012

(54) METHOD AND SYSTEM FOR SURFACE FILTERING OF SOLIDS FROM RETURN FLUIDS IN WELL OPERATIONS

(75) Inventor: David L. Droke, Houston, TX (US)

(73) Assignee: Bronco Oilfield Services, Inc., Oklahoma City, OK (US)

( * ) Notice: Subject to any disclaimer, the term of this patent is extended or adjusted under 35 U.S.C. 154(b) by 401 days.

(21) Appl. No.: 12/569,414

(22) Filed: Sep. 29, 2009

Related U.S. Application Data

(60) Provisional application No. 61/101,235, filed on Sep. 30, 2008.

(51) Int. Cl.
*E21B 21/06* (2006.01)
*E21B 43/00* (2006.01)

(52) U.S. Cl. ..... 175/206; 166/75.12; 166/267

(58) Field of Classification Search ..... 166/267, 166/75.11, 75.12, 75.15; 175/66, 206, 207
See application file for complete search history.

(56) References Cited

U.S. PATENT DOCUMENTS

| | | | |
|---|---|---|---|
| 3,850,238 | A | 11/1974 | Hill |
| 4,098,698 | A | 7/1978 | Lamothe |
| 4,303,127 | A | 12/1981 | Freel et al. |
| 4,420,040 | A | 12/1983 | Arbasak et al. |
| 5,570,744 | A | 11/1996 | Weingarten et al. |
| 6,068,053 | A | 5/2000 | Shaw |
| 6,641,730 | B2 | 11/2003 | Poole |
| 6,668,931 | B1 | 12/2003 | Tomlinson et al. |
| 6,790,367 | B2 | 9/2004 | Schmigel et al. |
| 6,883,614 | B2 | 4/2005 | Schmidt et al. |
| 6,892,816 | B2 | 5/2005 | Pringle et al. |
| 6,893,558 | B1 | 5/2005 | McGee et al. |
| 7,207,399 | B2 | 4/2007 | Duhe et al. |
| 7,275,606 | B1 | 10/2007 | Sims et al. |
| 7,377,336 | B2 | 5/2008 | Duhe et al. |
| 7,503,389 | B2 | 3/2009 | Delaloye et al. |
| 2005/0006150 | A1 | 1/2005 | Sims et al. |
| 2006/0070735 | A1 | 4/2006 | Guerra et al. |
| 2006/0237194 | A1 | 10/2006 | Donald et al. |

FOREIGN PATENT DOCUMENTS

| | | | |
|---|---|---|---|
| AU | 200197124 | B2 | 6/2002 |

*Primary Examiner* — Nam Nguyen
*Assistant Examiner* — Paul J Durand
(74) *Attorney, Agent, or Firm* — Mary M. Lee

(57) ABSTRACT

A system and method for separating solids from return fluids in well drill-out, flow back, well-test, and other production operations. Solids are collected in a filter comprising a perforate inner tube inside a solid outer tube with an annulus therebetween. The fluid stream from the well enters the filter through the inner tube so that the solids are captured inside and the filtrate flows out through the annulus. The filtrate is passed though a flow back line to a flow back tank. As needed, the solids are removed from the inner tube into a debris tube without interrupting the fluid flow through the filter. Chokes are included for equalizing the pressure along the flow path as the debris is moved from the filter to the debris tube and from the debris tube into to a debris pit so that dramatic changes in pressure are avoided.

18 Claims, 5 Drawing Sheets

PROCESS LOGIC TABLE

| | | Bypass Valve 82 | Isolation Valve 26 | Outlet Valve 62 | Outlet Valve 60 | Isolation Valve 36 | Purge Valve 74 | Choke Valve 76 | Choke Valve 42 |
|---|---|---|---|---|---|---|---|---|---|
| | INITIAL/NORMAL FLOW BACK MODE | Closed | Open | Closed | Open | Closed | Closed | Closed | Closed |
| CLEANING MODE | Step 1: equalize pressure across downstream isolation valve and open the valve | Closed | Open | Closed | Open | Closed | Open | Closed | Closed |
| | | Closed | Open | Closed | Open | Closed | Open | Partially | Closed |
| | | Closed | Open | Closed | Open | Closed | Closed | Closed | Closed |
| | | Closed | Open | Closed | Open | Open | Closed | Closed | Closed |
| | Step 2: move debris to pup joint | Closed | Open | Closed | Open | Open | Closed | Closed | Purge |
| | Step 3: isolate debris in pup joint | Closed | Open | Closed | Open | Closed | Closed | Closed | Closed |
| | Step 4: Remove debris | Closed | Open | Closed | Open | Closed | Open | Closed | Closed |
| | | Closed | Open | Closed | Open | Closed | Open | Partially | Open |
| | | Closed | Open | Closed | Open | Closed | Open | Purge | Open |
| | | Closed | Open | Closed | Open | Closed | Open | Closed | Open |
| | | Closed | Open | Closed | Open | Closed | Open | Closed | Closed |
| | | Closed | Open | Closed | Open | Closed | Closed | Closed | Closed |

FIG. 4

METHOD AND SYSTEM FOR SURFACE FILTERING OF SOLIDS FROM RETURN FLUIDS IN WELL OPERATIONS

CROSS-REFERENCE TO RELATED APPLICATIONS

This application claims the benefit of provisional application Ser. No. 61/101,235, filed Sep. 30, 2008, entitled "Plug Catcher," the contents of which are incorporated herein by reference.

FIELD OF THE INVENTION

The present invention relates generally to completion and stimulation of oil and gas and more particularly, but without limitation, to filtering return well fluids in a plug drill out operation.

BACKGROUND OF THE INVENTION

There are many situations while completing or performing remedial work on a well where it becomes necessary to isolate particular zones of a well. One reason for isolating a zone is for performing multiple stage downhole stimulations. Industry available products that will isolate the well bore to prevent passage of fluid to other zones are called "plugs."

Essentially a plug isolates some part of the well from another part of the well. There are several types of plugs, including bridge plugs and frac (fracture) plugs. A bridge plug or frac plug is placed within the wellbore to isolate upper and lower sections of a zone. Bridge plugs hold pressure from both directions, while a frac plug holds pressure from above but allows upward flow. Plugs may be temporary or permanent.

A plug is removed by drilling or milling through it with a bit or blade in combination with circulating a drilling fluid through well to bring up the debris. In a drilling/milling operation, fluid is circulated from the surface through the bit or mill to flush the debris and cuttings from the well. The fluid carries the cuttings and debris to the surface where it is piped to a return tank.

At times it is necessary to work on these wells in an underbalanced condition where the pressures on the well must be controlled by using a choke or choke manifold. A choke is basically a restriction in the return line to hold pressure against the returning flow stream. With the pump rate being constant, the choke or choke manifold will control the downhole pressure. The larger the choke size/opening, the lower the back pressure and the lower the downhole pressure. Conversely, the smaller the choke size/opening, the higher the back pressure and the downhole pressure.

Chokes can be fixed or adjustable. Fixed chokes, also called positive chokes, are basically an orifice and come in a variety of sizes. An adjustable choke is variable and can be controlled electrically, hydraulically, pneumatically, or manually.

Because of their small openings, both fixed (positive) choke and variable chokes are susceptible to debris blocking. Inadvertent restrictions in the flow path can cause undesirable conditions in the well bore associated with drilling and/or milling operations. A restricted flow stream will reduce the ability of the circulated fluid to carry the debris and cuttings to the surface. This condition is serious as it may result in the pipe becoming stuck in the wellbore.

Plugs can be constructed of various materials, including composite materials and metals, such as brass, steel, aluminum, and cast iron. Depending on the material of the plug, the cuttings and debris may include small particulates and/or large rubber or fibrous shreds. Factors determining the size and composition of the debris and cuttings include the differential pressure across the plug when it is milled or drilled, the size of the mill or bit, and the techniques used to break up the plug.

The amount of debris and cuttings produced is dependent on the pipe diameter, pressure rating, plug style and plug manufacture. Common casing size can range from 2⅜ to 9⅝ inches. For example, a 4½ inch plug can produce 300 cubic inches of loose debris. The number of plugs used in a single well is dependent on the number of zones. It is not uncommon to have as many as 15 plugs in a single well.

When a choke or choke manifold is used during a milling or drilling operation, the debris can cause the choke to plug causing instability in the milling or drilling operation. There are two common practices for choke installations in a plug milling operation. One is a single fixed choke bean located in or at the return tank. The other is a choke manifold.

If a single choke bean method is used, when debris clogs the choke, the well has to be shut-in and milling operations stopped until the choke can be cleaned and put back into service. If a choke manifold is used and debris clogs one of the chokes, that choke can be bypassed to the other parallel choke. In this process, one person typically is cleaning the clogged primary choke while another person is trying to adjust the secondary choke back to the desirable backpressure. Not only does this process require extra manpower, but there is also the possibility that both chokes get clogged at the same time and the well has to be shut-in until a choke is cleaned.

As debris collects on a choke, holding a consistent backpressure can be difficult. The choke is opened farther to compensate for the debris restriction; but as the choke is opened, the debris can dislodge, reducing the backpressure, or the debris could clog further increasing backpressure.

In a drilling/milling operation, it is beneficial to remove the milling shavings before the flow stream reaches the choke. Filters or strainers can be placed upstream of the choke to prevent the debris getting to the choke. However, in such systems, parallel filtering systems with a bypass valving arrangement may be required.

The present invention provides the ability to drill continuously multi-plug zones under most common conditions without interrupting the drilling/milling operation to clear a clogged choke. In addition, the invention provides a compact, modular, single filtering system that is easily rigged and can be cleaned while in service. These and other advantages of the invention will be apparent from the following description.

BRIEF DESCRIPTION OF THE DRAWINGS

FIG. 4 is a table illustrating the process steps of the filter method of the present invention.

DETAILED DESCRIPTION OF THE PREFERRED EMBODIMENT

Figure 1:
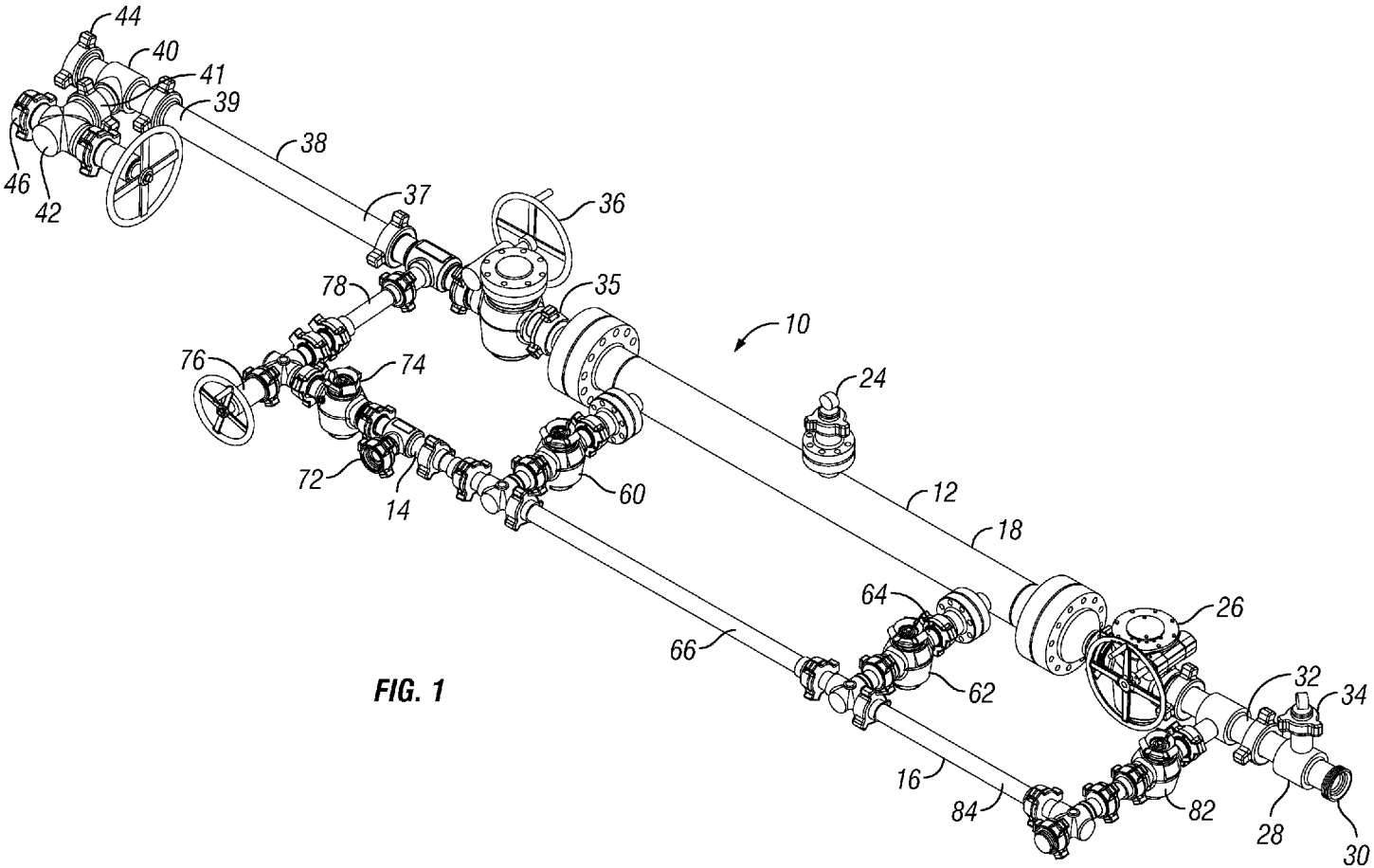
FIG. 1 is a perspective view of a modular filter system constructed in accordance with a preferred embodiment of the present invention.

With reference now to the drawings in general and to FIG. 1 in particular, there is shown therein a modular filtering system constructed in accordance with a preferred embodiment of the present invention and designated generally by the reference numeral 10. The system 10 is adapted for filtering debris and other particulates out of a fluid stream received from a well, such as an oil or gas well (not shown) undergoing a drill out, flow back, well-test or other operation. While only one system 10 is shown in the drawings, multiple systems may be used in parallel.

The system 10 comprises a main filter line 12, a flow back line 14, and a bypass line 16. The filter line 12 comprises a filter section 18. The filter section 18 is adapted to allow the fluid stream from the well to pass through while separating solids from the fluid. A preferred filter section 18 comprises an outer tube or manifold spool 20 inside of which is mounted an inner filter tube 22 shown in FIGS. 2 and 3, which will be described in more detail below.

A pressure sensor or gauge 24 is provided on the manifold spool 20. On the upstream end of the manifold spool 20 is an isolation valve 26 which connects to an inlet T 28. Extending upstream from the inlet T 28 is a fitting, such as the wellhead connection 30, which is adapted to connect to the wellhead (not shown). Thus, the valve 26, the inlet T 28 and connector 30 form an inlet line 32. A pressure sensor or gauge 34 is fixed to the inlet T 28 in the inlet line 32 to monitor the upstream pressure in the system 10.

On the downstream end of the spool 20 is a debris transfer line 35 comprising a downstream isolation valve 36 that connects the filter 18 to the inlet end 37 of a debris tube, such as a 3-inch pup joint 38. The outlet end 39 of the pup joint 38 is equipped with a T-joint 40 in a discharge line 41 to direct debris flow through a valved orifice, such as a choke valve, which may be an adjustable 2-inch orifice choke 42. The open end 43 (FIG. 2) of the pub joint 38 is provided with a removable cap 44. A magnet (not shown) may be included in the cap 44 to attract and capture metal fragments in the debris flow. The outlet of the choke 42 is equipped with a connector 46 for connecting the system 10 to the debris pit (not shown). As used herein, "debris pit" denotes any excavation, vessel or collector for containing debris or other solids recovered from the return well fluids.

Figure 2:
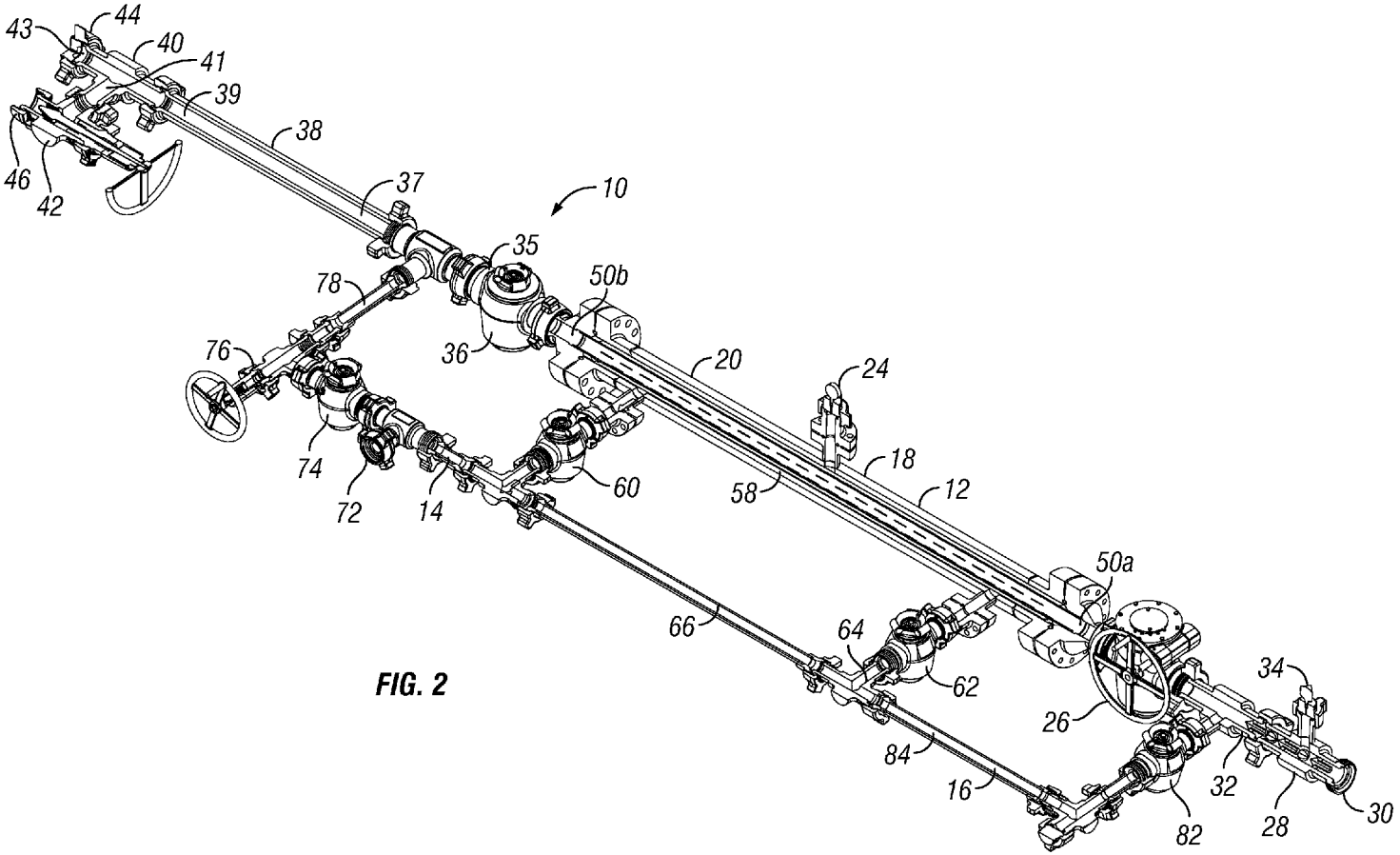
FIG. 2 is a partially cut-away perspective view of the filter system shown in FIG. 1.
Figure 3:
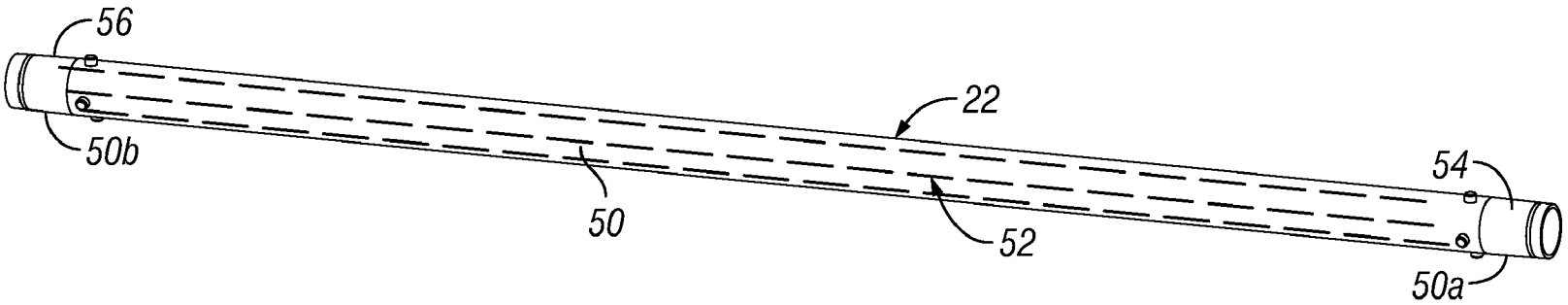
FIG. 3 is a perspective view of the filter screen preferably used in the system shown in FIGS. 1 and 2.

The filter tube 22 is shown best in FIG. 3, to which attention now is directed. The filter tube 22 comprises an elongate tubular body or member 50 with a plurality of slots, designated collectively at 52, forming a perforated side wall. The perforations 52 allow fluid communication between the inside and outside of the tube 22. The upstream or inlet end 50A and the downstream or outlet end 50B of the tubular member 50 are provided with collars 54 and 56 by which the tube 22 is mounted inside the spool 20, as seen best in FIG. 2.

The outer diameter (O.D.) of the filter tube 22 is less than the inner diameter (I.D.) of the manifold spool 20 to provide an annulus 58 (FIG. 2) to receive the filtrate, that is, the filtered fluid stream. In this way, during normal operation, the residue or debris in the fluid stream will be retained inside the filter tube 22 while the filtrate passes through the slots 52 in the annulus 58. For example, in the embodiment shown, the O.D. of the filter tube 22 is 3½ inches while the I.D. of the spool 20 is 5½ inches, providing a 1-inch annulus 58.

With continuing reference to FIGS. 1 and 2, the flow back line 14 preferably comprises a first outlet or flow back valve 60 connected to the downstream end of the manifold spool 20. The flow back valve controls the fluid flow from the filter to the flow back line and. A second outlet or backflow valve 62 in a backflow line 64 may also be included for uses to be described and, when included, is connected to the upstream end of the spool 20. A connecting pipe 66 makes a fluid connection between the first and valves 60 and 62. That is, the connecting pipe 66 forms a part of both the backflow line 64 and the bypass line 16 and is a common fluid connection to the flow back line 14.

An outlet T 70 in the flow back line 14 is connected to the outlet of the first outlet valve 60. A fitting or connector 72 is provided on the outlet T 70 to connect the T to the flow back tank for directing the filtrate to the flow back tank (not shown). "Flow back tank" is used broadly and refers to any vessel or collector suitable for holding fluids processed by the filter system 10. A purge valve 74 is connected to the outlet T 70. A valved orifice, such as a choke valve 76, is connected between the purge valve 74 and the main filter line 12 between the pup joint 38 and the downstream isolation valve 36 using a connecting joint 78 that forms a purge line.

Referring still to FIGS. 1 and 2, the bypass line 16 will be described. The bypass line 16 comprises a bypass valve 82 connected between the main filter line 12 and the second outlet valve 62 (or the first outlet valve 60, if there is no second valve 62). The inlet of the bypass valve 82 is connected to the main filter line 12 between in the inlet T 28 and the upstream isolation valve 26. The outlet of the bypass valve 82 is connected to the second outlet valve 62 (or first outlet valve 60) by a connecting joint 84 forming part of the bypass line 16.

Figure 5:
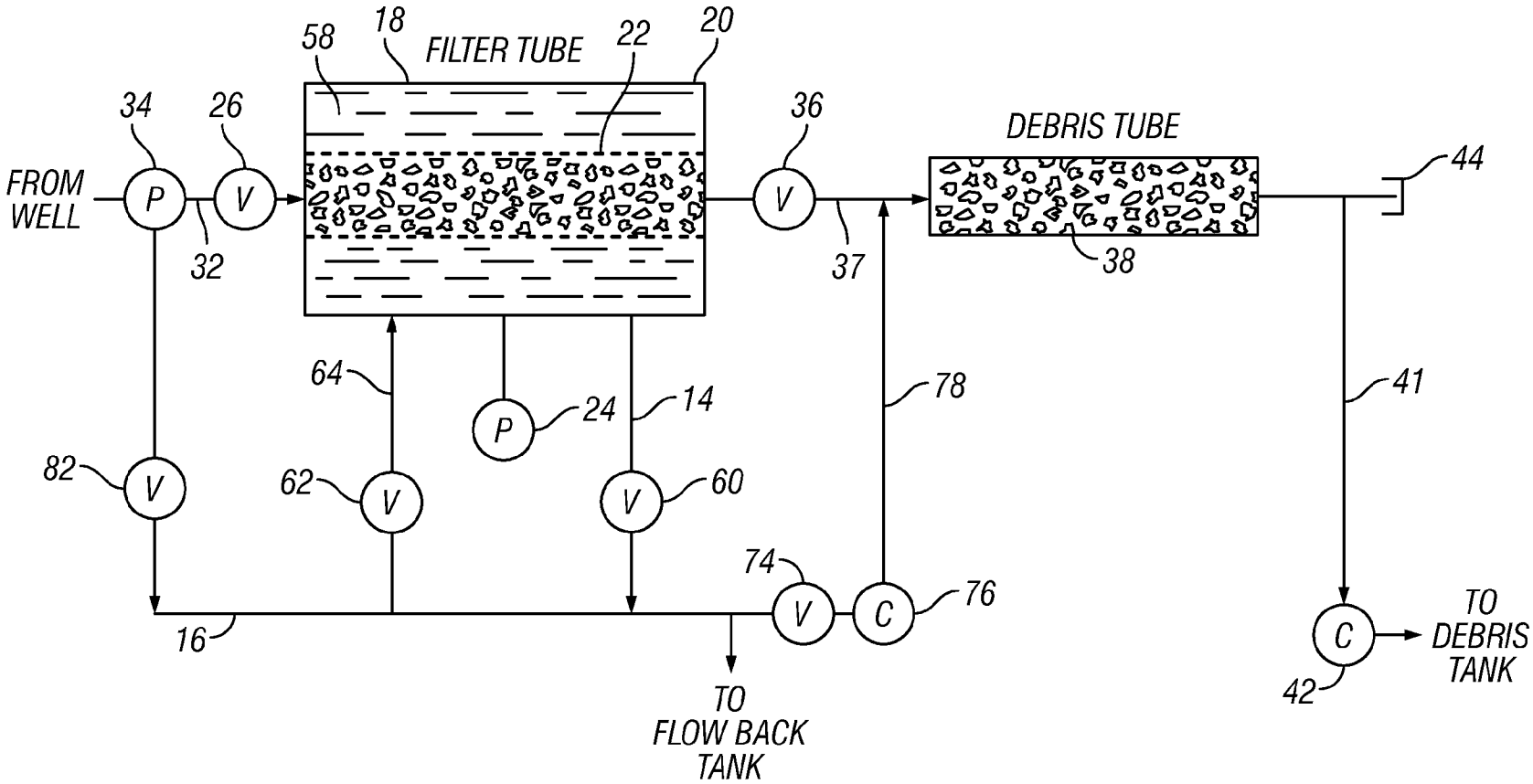
FIG. 5 is a flow chart illustrating the method of the present invention.

The use and operation of the inventive system is illustrated in the Process Logic Table shown in FIG. 4 and flow chart shown in FIG. 5, to which attention now is directed. The fluid stream enters the system 10 at the wellhead connection 30. With the upstream isolation valve 26 and the first outlet valve 60 open and the other valves closed, the fluid stream passes directly through the filter section 18. The debris collects or stacks up inside in the filter tube 22 and the filtrate passes through the annulus 58, out the outlet valve 60 in the flow back line 14, and finally out the outlet T 70 to the flow back tank.

The operator monitors the system 10 to determine when the filter tube 22 is full or near full and needs cleaning. This determination may be made by monitoring the pressure differential between the upstream and downstream pressures as indicated by the gauges 24 and 34. Alternately, cleaning intervals may be scheduled based on the filter capacity and the expected volume of debris generated by the milled plug. Still further, the cleaning mode may be scheduled at regular intervals to ensure that the filter never becomes overly clogged. The control of the system 10 as described herein is carried out manually by a human operator. However, it will be understood that the operation of the system 10 alternately be controlled by a computer-run control system (not shown).

The cleaning mode begins by equalizing the pressure across the downstream isolation valve 36 and then opening that valve. First, the purge valve 74 is opened and then the purge choke 76 is adjusted. Next, the purge valve 74 and choke 76 are both closed, and the isolation valve 36 is opened. Next, the debris choke 42 is adjusted to allow the debris to move into the pup joint 38. The debris may then be isolated in the pup joint 38 by closing the isolation valve 36 and the debris choke 42. It will be appreciated that this cleaning operation can be performed without disrupting the return flow from the well through the filter.

To remove the debris from the pup joint 38, the purge valve 74 is opened, the choke 76 is adjusted, and the debris is purged from the system 10. When the purge is completed, the purge choke 76 is closed, the debris choke 42 is closed, and the purge valve 74 is closed. The system 10 now is reset to the normal flow back mode.

In some instances, the filter may be cleared manually. To do so, the upstream isolation valve 26, the purge valve 74, and both the outlet valves 60 and 62 are closed, and the bypass valve 82 and the downstream isolation valve 36 are opened. This diverts the flow stream straight through the bypass line 16 and out the flow back line 14, totally bypassing the filter line 12. While the fluid stream is thus diverted, but not interrupted, the filter section 18 may be cleaned manually with a suitable tool.

The filter system 10 provides an important advantage during servicing of the system between uses, that is, when the system is disconnected from the well or other source. It will be seen from FIGS. 1 and 2 that, in the preferred embodiment the filter section 18 and the pup joint 38 are both straight and aligned coaxially with each other and with the inlet 30 the capped end 43. When the cap 44 is removed from the capped end 43, a straight line of sight is formed from the end to the inlet 30. This allows visual inspection of the inside of the inner tube 22 of the filter.

It will also now be apparent that during normal operation of the system, the flow stream flows first into the inside of the filter tube 22 and out through the slots 52 of the tube. In some situations, it is advantageous to reverse this flow, that is, to direct the fluid stream first into the annulus 58, through the slots 52 to the inside of the filter tube 22. This is accomplished by opening the bypass valve 82, the downstream isolation valve 36, and the second outlet valve 62, and closing the upstream isolation valve 26, the first outlet valve 60, the purge valve 74, and the purge choke 76. This will direct the fluid first through the bypass line 16, then through the second outlet valve 62 into the annulus 58 of the filter section 18. The filtrate would flow through the slots 52, then through the inside of the filter 22 and out through the open isolation valve 36. The debris would remain trapped in the annulus 58 until removed.

As used herein, "valve" refers very broadly to any device capable of blocking or diverting fluid flow through a conduit. As used herein, a "choke" refers broadly to any device capable of modulating the flow rate of a fluid through a conduit. Thus, as used herein, a "valve" may or may not function as a "choke," but a "choke" denotes a valve or other device with a fluid throttling capability and thus includes many types of valves.

The embodiments shown and described above are exemplary. Many details are often found in the art and, therefore, many such details are neither shown nor described. It is not claimed that all of the details, parts, elements, or steps described and shown were invented herein. Even though numerous characteristics and advantages of the present inventions have been described in the drawings and accompanying text, the description is illustrative only. Changes may be made in the details, especially in matters of shape, size, and arrangement of the parts within the principles of the inventions to the full extent indicated by the broad meaning of the terms of the claim(s).

What is claimed is:

1. A filter system for separating the debris from the fluid in a fluid stream coming from a well and for directing the filtrate to a flow back tank and the debris to a debris pit, the system comprising:

an inlet line connectable to the well;

a filter connected to the inlet, the filter comprising:

an outer tube, and;

an inner tube inside the outer tube, the inner tube having an inlet end and outlet end and a perforated sidewall therebetween, the inner tube being sized to provide an annulus between the inner tube and the outer tube, wherein the inlet end is connected to the inlet line so that the fluid stream passes from the well into the inner tube and so that the filtrate passes through the perforated sidewall and into the annulus and so that the debris collects inside the inner tube;

a flow back line connected to the annulus of the filter for directing the filtrate to the flow back tank;

a debris tube having an inlet and an outlet and adapted to receive debris purged from the inner tube of the filter;

a debris transfer line connecting the outlet end of the inner tube and the inlet of the debris tube;

a discharge line for passing debris from the debris tube into the debris pit;

a downstream filter valve for controlling passage of debris through the debris transfer line;

a purge line connecting the flow back line to the debris transfer tube;

a debris choke for modulating flow of filtrate through the debris tube; and a purge choke for modulating flow of debris through the discharge line;

whereby debris in the inner tube of the filter can be passed into the debris tube and out through the discharge line without interrupting flow of the fluid stream through the filter.

2. The filter system of claim 1 further comprising:

an upstream filter valve in the inlet line for controlling the passage of fluid from the well into the filter;

a bypass line for diverting fluid from the inlet line upstream of the upstream filter valve into the flow back line;

a bypass valve for controlling fluid flow through the bypass line;

whereby the filter can be isolated from the fluid stream from the well without interrupting the fluid flow.

3. The filter system of claim 2 further comprising:

a backflow line connecting the bypass line to the annulus of the filter;

a backflow valve in the backflow line for controlling passage of the fluid stream from the bypass line into the annulus; and a flow back valve to control the fluid flow from the filter to the flow back line.

4. The filter system of claim 1 wherein the backflow line connects to the upstream end of the annulus of the filter.

5. The filter system of claim 1 wherein the flow back line connects to the downstream end of the annulus of the filter.

6. The filter system of claim 1 further comprising a purge valve in the flow back line upstream of the purge choke.

7. The filter system of claim 1 further comprising a pressure sensor in the inlet line.

8. The filter system of claim 7 further comprising a pressure sensor in the annulus of the filter.

9. The filter system of claim 1 wherein the discharge choke is a choke valve.

10. The filter system of claim 1 wherein the discharge line comprises an end joint with an open end covered by a removable cap, the end joint extending from the outlet of the debris tube, wherein the inlet line, the inner tube of the filter, the debris transfer line between the filter and the debris tube, the debris tube, and the end joint are all straight tubular members that are coaxially aligned to provide a line of sight along the entire length thereof whereby the inside of the inner tube is visible from the open end of the end joint when the system is detached from the well to verify the empty condition of the filter.

11. The filter system of claim 10 further comprising a magnet in the cap for trapping metal fragments in the debris.

12. The filter system of claim 1 wherein the upstream filter valve is an isolation valve.

13. The filter system of claim 1 wherein the downstream filter valve is an isolation valve.

14. The filter system of claim 1 wherein the perforated sidewall of the inner tube of the filter comprises a plurality of perforations.

15. The filter system of claim 14 wherein the perforations are elongate slots extending lengthwise in the sidewall.

16. The filter system of claim 1 wherein the inlet is a wellhead connector.

17. The filter system of claim 1 wherein the debris tube is a pup joint.

18. The filter system of claim 1 wherein the discharge choke is an orifice choke.

* * * * *